US011879682B1

(12) United States Patent
Vijayan et al.

(10) Patent No.: US 11,879,682 B1
(45) Date of Patent: Jan. 23, 2024

(54) REFRIGERATION APPLIANCE AND METHOD FOR OPERATION

(71) Applicant: Haier US Appliance Solutions, Inc., Wilmington, DE (US)

(72) Inventors: Vineeth Vijayan, Louisville, KY (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 18/095,781

(22) Filed: Jan. 11, 2023

(51) Int. Cl.
*F25D 29/00* (2006.01)
*F25D 23/02* (2006.01)

(52) U.S. Cl.
CPC ..... *F25D 29/005* (2013.01); *F25D 23/028* (2013.01); *F25D 2400/361* (2013.01); *F25D 2600/02* (2013.01); *F25D 2700/02* (2013.01)

(58) Field of Classification Search
CPC ..... F25D 23/028; F25D 29/005; F25D 2400/361; F25D 2600/02; F25D 2700/02
See application file for complete search history.

(56) References Cited

U.S. PATENT DOCUMENTS 9,307,888 B2 4/2016 Baldwin et al.
2018/0292127 A1* 10/2018 Park ..... F25D 29/005

FOREIGN PATENT DOCUMENTS

CN 208012227 U 10/2018
CN 105204689 B 8/2019

* cited by examiner

*Primary Examiner* — Jonathan Bradford
(74) *Attorney, Agent, or Firm* — Dority & Manning, P.A.

(57) ABSTRACT

A refrigeration appliance and method for operation are provided. The appliance includes a cabinet and a door. The cabinet includes a controller, a first communications device, and a magnetic device. the door includes an energy source, a first switch, a second switch, a second communications device, and a user interface device. The second switch is operably coupled to the second communications device and the user interface device. The second communications device is in selective operable communication with the first communications device. The first switch is configured to operably couple the energy source to the second switch to allow energy to flow to the second switch, the second communications device, and the user interface device when the door is open. The first switch is configured to discontinue energy flow to the second switch when the door is closed.

20 Claims, 4 Drawing Sheets

REFRIGERATION APPLIANCE AND METHOD FOR OPERATION

FIELD

The present disclosure generally pertains to refrigeration appliances, and, more specifically, control systems and methods for operating refrigeration appliances.

BACKGROUND

Refrigeration appliances, such as beverage chilling and humidity control systems, may include a user interface panel configured to receive user inputs and communicate with a controller to set a desired temperature at the appliance. Such refrigeration appliances require a power source for operating the user interface panel. Positioning the user interface panel at a door may be inhibited by a requirement to power the user interface panel. Providing power through the door may be cost prohibitive or inhibit positioning of the door to the cabinet.

As such, an appliance and method for operation that addresses one or more of these issues and deficiencies is desired.

BRIEF DESCRIPTION

Aspects and advantages of the invention will be set forth in part in the following description, or may be understood from the description, or may be learned through practice of the invention.

An aspect of the present disclosure is directed to a refrigeration appliance including a cabinet and a door. The cabinet includes a refrigeration compartment, a controller, a first communications device, and a magnetic device, wherein the controller is operably coupled to the first communications device. The door is attachable to the cabinet and configured to open and close to selectively allow access to the refrigeration compartment. The door includes an energy source, a first switch, a second switch, a second communications device, and a user interface device. The second switch is operably coupled to the second communications device and the user interface device. The second communications device is in selective operable communication with the first communications device. The first switch is configured to operably couple the energy source to the second switch to allow energy to flow to the second switch, the second communications device, and the user interface device when the door is open. The first switch is configured to discontinue energy flow to the second switch when the door is closed.

Another aspect of the present disclosure is directed to a system for operating a refrigeration appliance. The system includes a cabinet including a first communications device, and a magnetic device. The controller is operably coupled to the first communications device. The system includes a door attachable to the cabinet and including a controller compartment. The system further includes a control system positioned at the controller compartment. The control system includes an energy source, a first switch, a second switch, a second communications device, and a user interface device. The control system is configured to close a circuit from the first switch to the second switch when the first switch is removed from magnetic communication with the magnetic device, and energize the second switch, the second communications device, and the user interface device when the first switch is operably coupled to the second switch.

Yet another aspect of the present disclosure is directed to a method for operating a refrigeration appliance. The method includes closing a circuit from an energy source to a second switch through a first switch, wherein the energy source, the first switch, and the second switch are positioned at a door, and wherein the circuit is closed when the first switch is removed from magnetic communication with a magnetic device at the cabinet when the door is opened. The method includes energizing a control system at the door, the control system including the second switch, a second communications device, and a user interface device when the first switch is operably coupled to the second switch. The method includes wirelessly coupling a first communications device at the cabinet to the second communications device at the door when the control system is energized, wherein wirelessly coupling the first communications device to the second communications device permits wireless communication of a control signal from the user interface device to a controller at the cabinet. The method includes opening the circuit between the first switch and the second switch to de-energize the control system at the door when the door is closed.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
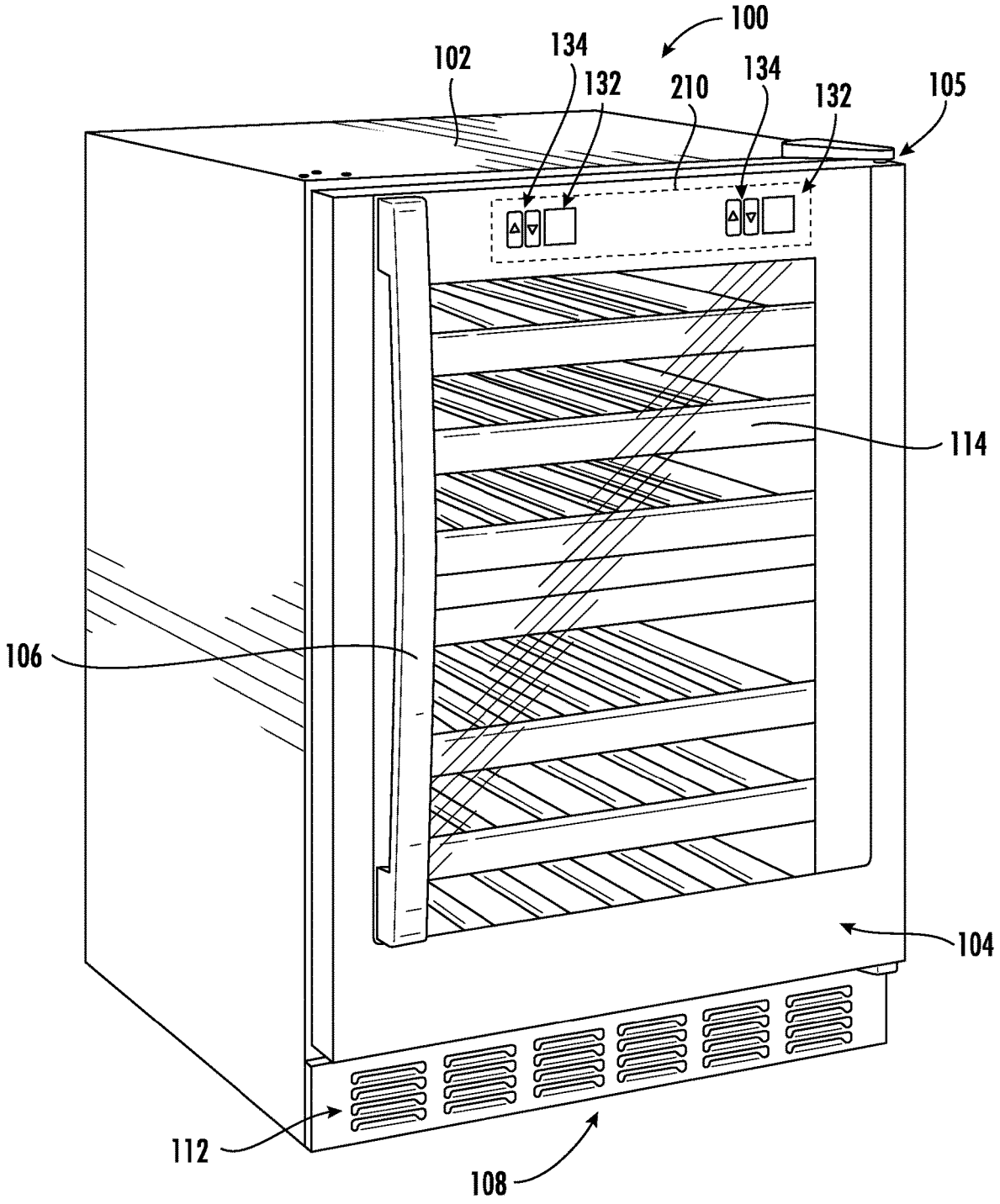
FIG. 1 depicts a perspective view of an exemplary embodiment of a refrigeration appliance in accordance with aspects of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Figure 2:
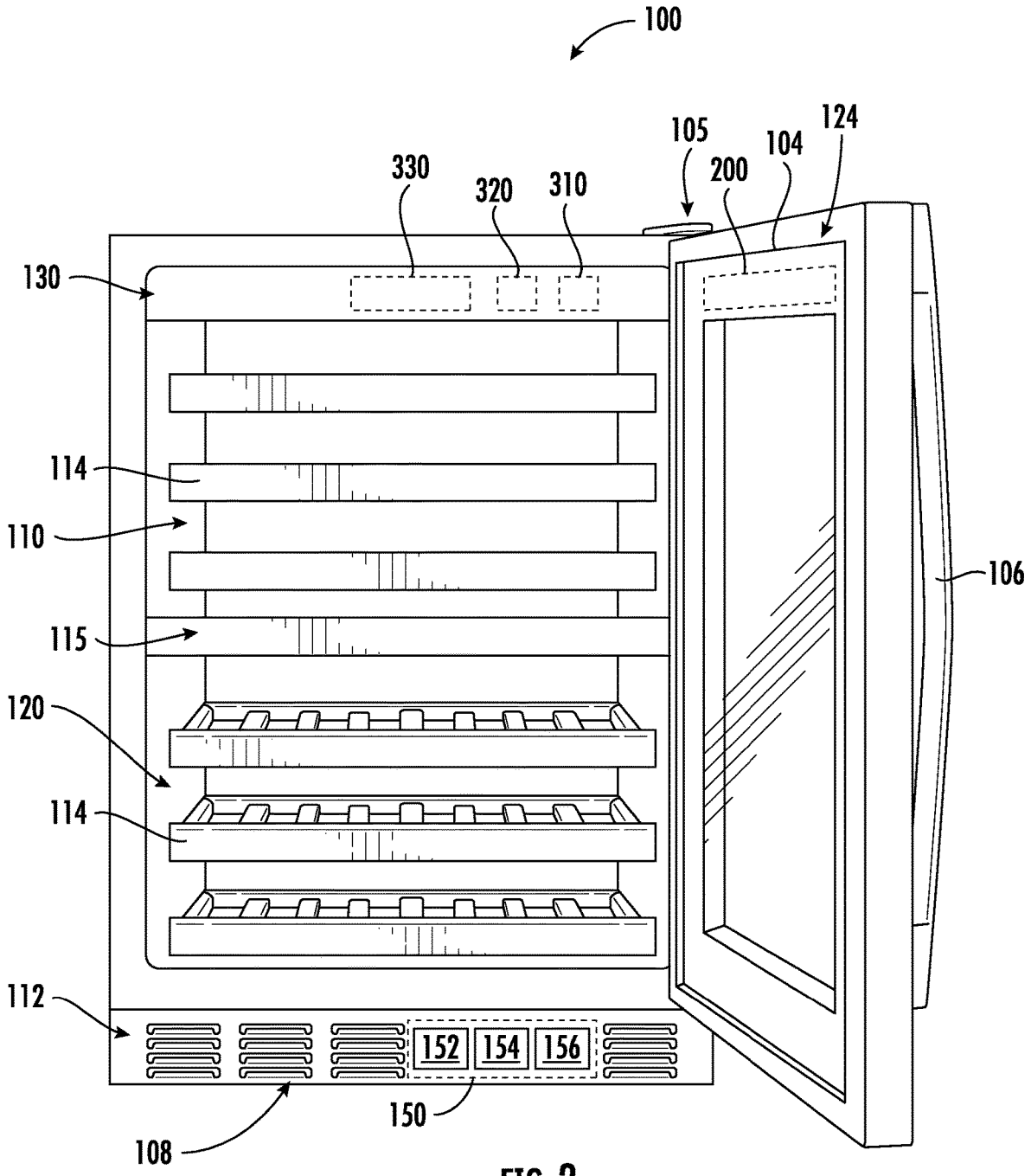
FIG. 2 depicts a front view of an exemplary embodiment of a refrigeration appliance in accordance with aspects of the present disclosure.

Referring to FIG. 1, a perspective view of an embodiment of a refrigeration appliance 100 is provided. FIG. 2 provides a view of the refrigeration appliance 100 in which a door 104 is open to further depict an interior of the appliance 100. FIG. 1 depicts the refrigeration appliance 100 in which the door 104 is in a closed position. FIG. 2 depicts the refrigeration appliance 100 in which the door 104 is in an open position. As used herein, "open" may refer to any one or more positions in which the door 104 is detached at a distal end from a pivot point or hinged attachment 105 operably connecting the door 104 to a cabinet 102. Accordingly, "open" may refer to partially open or fully open, such as depicted in FIG. 2. Referring to FIGS. 1-2, the appliance 100 includes the cabinet 102 forming a one or more cooling compartments in the interior, such as may include one or both of a first compartment 110 or a second compartment 120. The first compartment 110 may be thermally separate from the second compartment 120. The cabinet 102 may include a plurality of walls forming, at least in part, the plurality of cooling compartments 110, 120. One or more trays 114 is positioned within the interior, such as at the compartments 110, 120. The tray 114 may be configured to hold one or more beverages. An interior compartment wall 115 separates the first compartment 110 from the second compartment 120. A door 104 is attached to the cabinet 102 and configured to open and close, e.g., via hinged attachment 105 to the cabinet 102, to allow access to the compartment 110, 120. The door 104 may include a handle 106 at which a user may utilize, e.g., pull, to open and close the door 104. The handle 106 may be positioned at the door 104 substantially distal to the hinged attachment 105.

Although depicted and described as including the first compartment 110 and the second compartment 120, it should be appreciated that various embodiments of the refrigeration appliance 100 provided herein may include a single cooling compartment, or three cooling compartments, or four cooling compartments, or more, etc.

Certain embodiments of the refrigeration appliance 100 may be configured as a beverage cooler appliance, such as, but not limited to, a wine cooler, a hard drink cooler, a soft drink cooler, or a cooling apparatus for any desired beverage(s) or combination thereof, etc. Still certain embodiments of the refrigeration appliance 100 may be configured as a counter-top refrigeration appliance, an under-counter refrigeration appliance, a mini-fridge, etc., such as may be configured to cool or freeze beverages, foodstuffs, or combinations thereof.

The appliance 100 includes a utility compartment 108 at which operational components 150 for cooling and distributing air or other cooling fluid may be disposed. In some embodiments, such as depicted in FIGS. 1-2, the utility compartment 108 is positioned at a bottom portion of the cabinet 102, such as underneath the compartments 110, 120. In other embodiments, the utility compartment 108 may be positioned at a back portion, a top portion, or a side portion of the cabinet 102. In still some embodiments, the utility compartment 108 may include vent openings 112 configured to allow fluid flow, e.g., air flow, or thermal communication of air at various components at the utility compartment 108, e.g., evaporators, condensers, fans, etc.

Referring to FIG. 2, operational components 150 of the appliance 100 may include a heat exchanger system 152 configured to remove heat from, or otherwise cool, the compartment 110, 120. The heat exchanger system 152 may include an evaporator positioned in thermal communication with air at the compartment 110, 120. The heat exchanger system 152 may include a condenser positioned in operable communication with the evaporator, such as to provide a heat exchange fluid through the evaporator to remove heat from air provided from the compartments 110, 120.

Embodiments of the appliance 100 may include a damper assembly 154 configured to selectively distribute conditioned air from the heat exchanger system 152 to the compartment 110, 120. The damper assembly 154 may include any type of valve, manifold, or flow control device configured to selectively permit flow to the compartment 110, 120.

A flow device 156, such as a selectively actuatable flow device, may be positioned in fluid communication with the first compartment 110. In some embodiments, the flow device 156 is a fan, nozzle, or pump configured to selectively operate to flow air along a flowpath from the compartment 110, 120 to the heat exchanger system 152.

The appliance 100 may include one or more sensors configured to determine, measure, or otherwise obtain an environmental condition corresponding to the compartment 110, 120. The environmental condition may include a temperature and/or humidity corresponding to the compartment 110, 120. Sensor(s) may be operably coupled to controller 310, such as via wired or wireless communication, to communicate the environmental condition to the controller 310, such as to selectively articulate one or more components of the operational components 150 to desirably cool the compartment 110, 120 based on a user selection or predetermined schedule.

Referring to FIGS. 1-2, the appliance 100 includes a controller 310 configured to execute instructions that cause the appliance 100 to perform operations. Controller 310 is configured to regulate operation at the appliance 100. In some embodiments, the controller 310 is positioned at the cabinet 102. In some embodiments, input/output ("I/O") signals are routed between controller 310 and operational components 150 of appliance 100, such as a heat exchanger system 152, a damper assembly 154, a flow control device 156, etc., along wiring harnesses that may be routed through the cabinet 102. Alternatively, or in combination, signals may be communicated via wireless communications between controller 310 and various operational components 150 of the appliance 100.

The refrigeration appliance 100 includes a user interface device 210 through which a user may select various operational features and operating modes and monitor progress or environmental conditions of the appliance 100. The user interface device 210 may represent a general purpose I/O ("GPIO") device or functional block. Additionally, the user interface device 210 may include one or more input components 134, such as one or more of a variety of electrical, mechanical, or electro-mechanical input devices including rotary dials, push buttons, touchscreen devices, haptic feedback devices, and touch pads. The user interface device 210 may also include a display component 132, such as a digital or analog display device designed to provide operational feedback (e.g., compartment temperature, humidity, etc.) to a user. The user interface device 210 is in communication with the controller 310 via one or more signal lines or shared communication buses, such as wireless communications devices 220, 320 (FIG. 3) described further herein.

In some embodiments, the appliance 100 may be configured as a dual environment appliance at which a first environment is provided and controlled at the first compartment 110 and a second environment is provided and controlled at the second compartment 120. The environment, and control thereof, may include a temperature and/or humidity different and separately controlled from one another. Controller 310 may include a first input component 134 configured to adjust or modulate temperature or humidity at the first compartment 110 and a second input component 134 configured to adjust or modulate temperature or humidity at the second compartment 120. A first display component 132 may display environmental conditions (e.g., temperature, humidity) at the first compartment 110, and a second display component 132 may display environmental conditions at the second compartment 120. The user interface device 210 may allow the user to toggle between current conditions at the compartment 110, 120 and set conditions to which the appliance 100 is targeting (e.g., temperature and/or humidity) relative to the compartment 110, 120. It should be appreciated that embodiments of the appliance 100 may include a single controller 310, display component 132, or input component 134 configured to toggle between current environmental conditions and set conditions between the first compartment 110 and the second compartment 120.

Controller 310 may include one or more processing devices and one or more memory devices. As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 310 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 310 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors, such as one or more steps of a method for operating an appliance such as provided herein. It should be appreciated that the instructions can be software written in any suitable programming language or can be implemented in hardware. Additionally, or alternatively, the instructions can be executed logically and/or virtually using separate threads on one or more processors. Executed instructions cause the appliance 100 to perform operations, such as one or more steps of method 1000 provided further herein.

Figure 3:
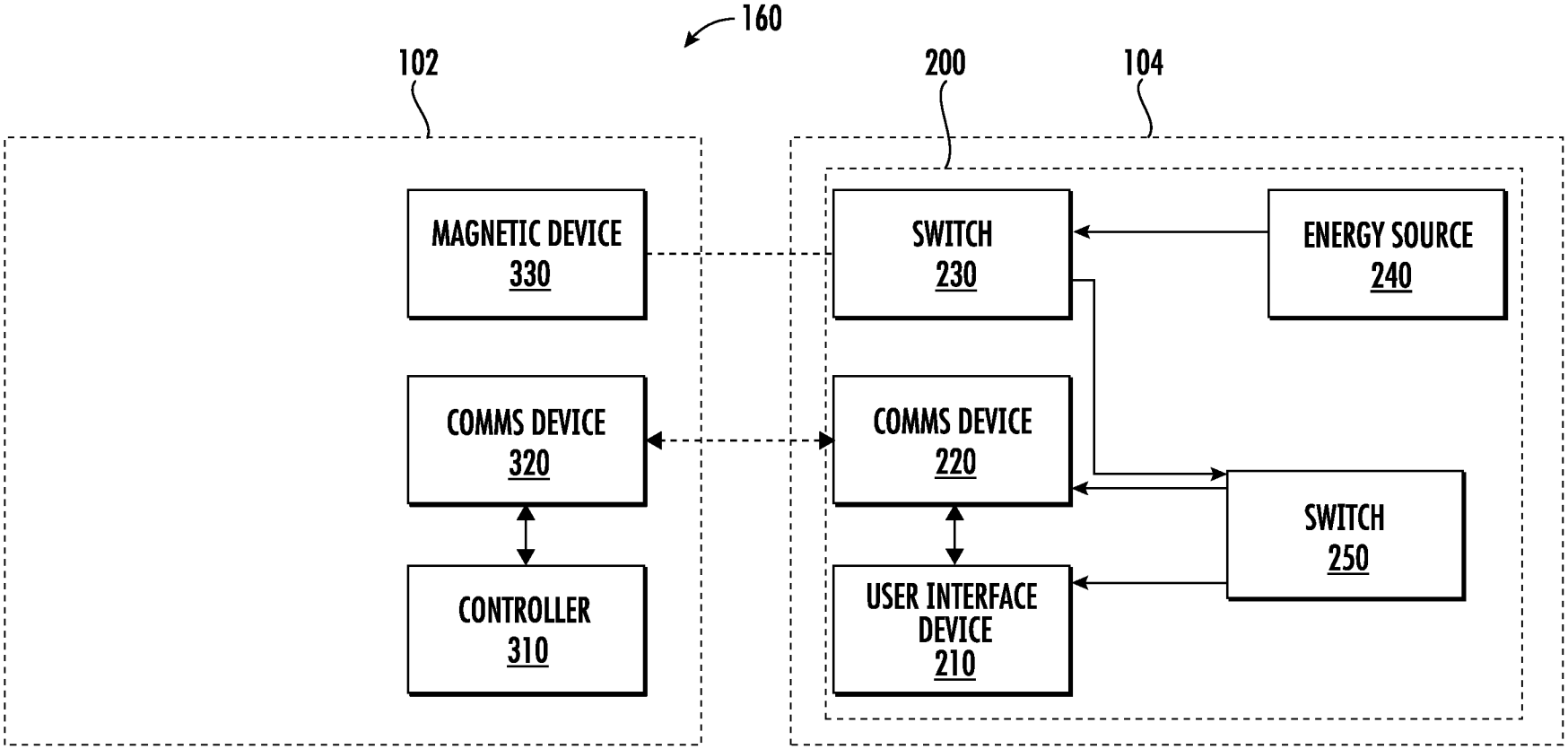
FIG. 3 schematically depicts an exemplary embodiment of a system for operating a refrigeration appliance in accordance with aspects of the present disclosure.

Referring now to FIG. 3, a schematic embodiment of a system 160 for operating an appliance is provided. The appliance 100 includes the system 160 having a first communications device 320 and a second communications device 220 configured to send or receive signals, such as instructions as may include one or more steps of method 1000 further described herein. As further described herein, the first communications device 320 may be configured as a communications receiver device and the second communications device 220 may be configured as a communications transmission device. However, in various embodiments, one or both of the communications devices 220, 320 may be configured as transceivers configured to both receive and transmit signals. Embodiments of the communications devices 220, 320 may include any suitable communications devices or protocols, such as, but not limited to, via Wi-Fi®, Bluetooth®, Zigbee®, wireless radio, laser, infrared, Ethernet type devices and interfaces, etc.

The controller 310 is communicatively coupled to the first communications device 320, such as to receive signals from the first communications device 320. The appliance 100 includes the controller 310, the first communications device 320, and a magnetic device 330 (e.g., a magnet) positioned at the cabinet 102. The appliance 100 includes an energy source 240, a first switch 230, a second switch 250, a second communications device 220, and a user interface device 210 positioned at the door 104. The door 104 may form a controller compartment 124 (FIG. 2) configured to receive and store a control system 200. The control system 200 includes the energy source 240, the first switch 230, the second switch 250, the second communications device 220, the user interface device 210, or combinations thereof.

The energy source 240 is operably coupled to transmit energy to the first switch 230. The first switch 230 may include an electromagnetic switch, such as a reed switch. The first switch 230 is positioned at the door 104 such that, when the door is closed (e.g., FIG. 1), the first switch 230 is in magnetic communication with the magnetic device 330 at the cabinet 104. When the first switch 230 is in magnetic communication with the magnetic device 330, magnetism causes the first switch 230 to open, such as to disable or discontinue flow of energy from the energy source 240 through the first switch 230 to the second switch 250. The first switch 230 is positioned at the door 140 such that, when the door is open (e.g., FIG. 2), the first switch 230 is removed from magnetic communication with the magnetic device 330 at the cabinet 140. When the first switch 230 is removed from magnetic communication with the magnetic device 330, the first switch 230 is allowed to close, such as to permit or continue flow of energy from the energy source 240 through the first switch 230 to the second switch 250.

The second switch 250 is operably coupled to the second communications device 220 and the user interface device 210. Energy received at the second switch 250 transfers to the second communications device 220 and the user interface 210. For instance, energy transferred to the second communications device 220 permits wireless communication of the second communications device 220 at the door 104 with the first communications device 320 at the cabinet 104. In another instance, energy transferred to the user interface device 210 permits user operation of the user interface device 210, such as to receive user inputs at the input component 134, to activate or light-up the display component 132, to display environmental conditions of the compartment 110, 120 at the display component 132, or other user interactions at the user interface device 210. As such, the second communications device 220 is in selective operable communication with the first communications device 320. In various embodiments, the first switch 230 is serially coupled to the second switch 250. However, it should be appreciated that the first switch 230 may be selectively coupled to the second switch 250 in any appropriate configuration.

In various embodiments, the energy source 240 is positioned at the door 104 and physically de-coupled from the cabinet 102. For instance, the energy source 240 may be contained at the controller compartment 124 at the door 104 without wires or conduits physically extending between the door 104 and the cabinet 102. In some embodiments, the energy source 240 is a battery. For instance, the energy source 240 including the battery is positioned at the controller compartment 124. In various embodiments, the energy source 240 is a non-rechargeable battery or primary battery. The energy source 240 forming a non-rechargeable battery may include any appropriate battery structure having irreversible electrochemical processes, such as in contrast to rechargeable batteries. In some embodiments, the energy source 240 includes a lithium primary cell (e.g., including a thionyl chloride cell, an oxalyl chloride cell, etc.). The energy source 240 may include any appropriate quantity of cells and arrangements (e.g., series or parallel).

Although depicted as including the hinged attachment 105 at the right side of the cabinet 102, in various embodiments the hinged attachment 105 may be positioned at the left side of the cabinet 102. In still various embodiments, the magnetic device 330 may be positioned at the cabinet 102 such that the first switch 230 is in magnetically communication with the magnetic device 330 when the door 104 is closed and regardless of whether the hinged attachment 105 is at the right side or the left side of the cabinet 102. For instance, the magnetic device 330 may be positioned along a center area of the cabinet 102 at or proximate to a face at which the door 104 couples to the cabinet 102. The first switch 230 may be positioned along a center area of the door 104 at or proximate to a face at which the door 104 couples to the cabinet 102. Embodiments such as provided herein may obviate routing physical electrical or electronic conduits, wires, harnesses, etc. through the door to the cabinet. Embodiments of the appliance 100 provided herein allow for the control system 200 to be positioned at the door 104 regardless of positioning of the hinged attachment 105. For instance, the same door 104 may be configured for right side pivoting or left side pivoting by moving the hinged attachment 105.

Referring to FIG. 3, in some embodiments, the user interface device 210 may include one or more timer devices configured to discontinue energy draw from the energy source 240 at or beyond a time threshold, such as further described herein.

Figure 4:
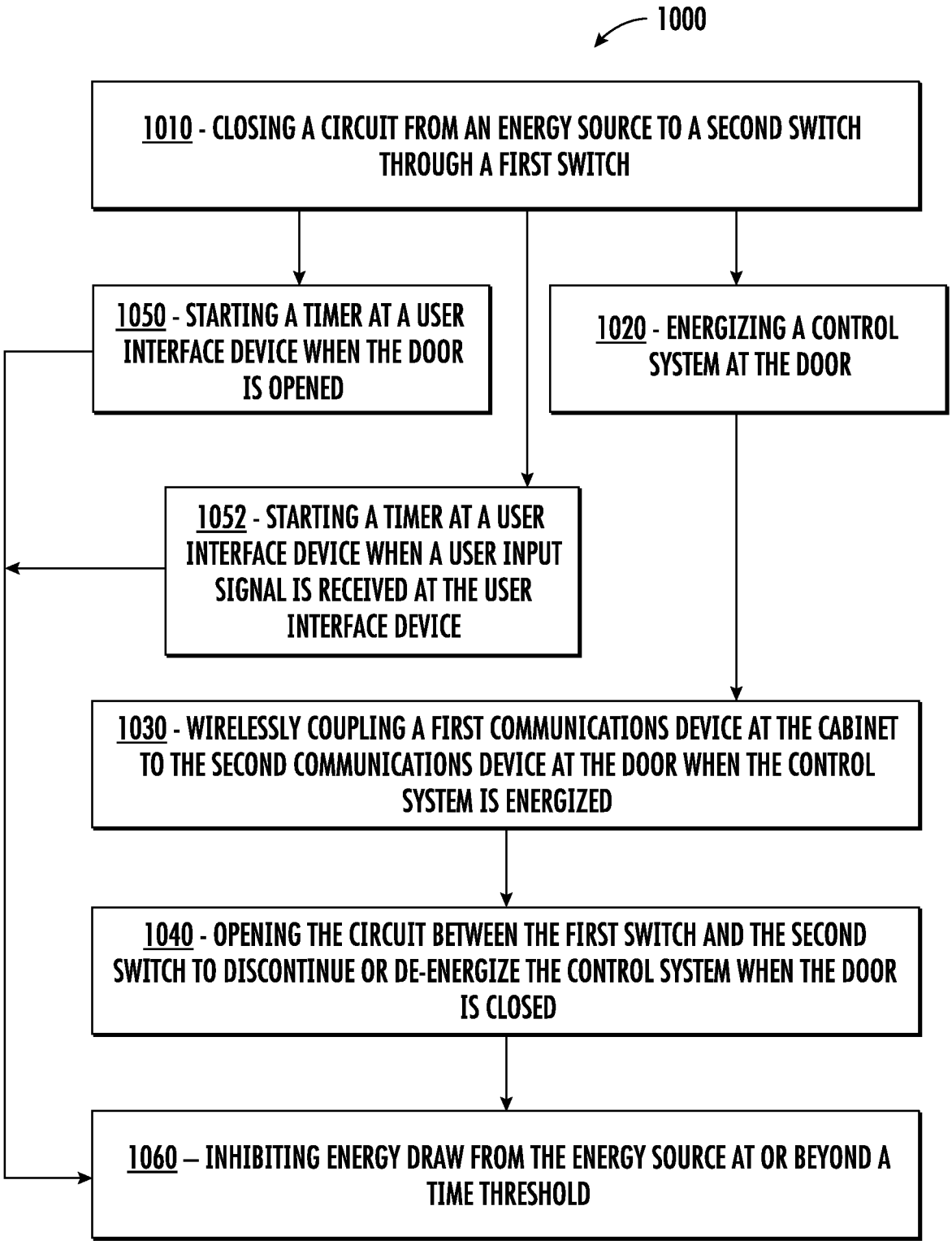
FIG. 4 outlines steps of a method for operating a refrigeration appliance in accordance with aspects of the present disclosure.

Referring now to FIG. 4, a flowchart outlining exemplary steps of a method for operating a refrigeration appliance (herein, "method 1000"). Embodiments of the method 1000 provided herein may be utilized for operating embodiments of the appliance 100, such as instructions or steps stored or executed by controller 310 to cause the appliance 100, or one or more of the heat exchanger system 152, the damper assembly 154, or flow device 156 to perform operations in accordance with one or more steps of embodiments of method 1000. Various embodiments of method 1000 may include steps that may be re-ordered, iterated, omitted, or included with other operations. Still various embodiments of method 1000 may be executed at other embodiments of refrigeration appliances such as described herein.

Method 1000 may include at 1010 closing a circuit from an energy source (e.g., energy source 240) to a second switch (e.g., second switch 250) through a first switch (e.g., first switch 230). The energy source, the first switch, and the second switch are positioned at a door (e.g., door 104), such as depicted and described in regard to FIGS. 1-3. The circuit is closed when the first switch is removed from magnetic communication with a magnetic device (e.g., magnetic device 330) at the cabinet (e.g., cabinet 102) when the door is opened.

Method 1000 may include at 1020 energizing a control system (e.g., control system 200) at the door. In various embodiments, energizing the control system includes closing the second switch to allow energy to transmit to a communications device at the door (e.g., second communications device 220). In an embodiment, method 1000 at 1020 includes energizing the control system after receiving a user input signal at a user interface device (e.g., user interface device 210), such as at an input component (e.g., input component 134) or display component (e.g., display component 132) at the user interface device.

In an embodiment, method 1000 may at 1010 close the first switch to allow energy to transmit to the second switch, and the second switch may be closed and method 1000 at 1020 energizes the control system.

In another embodiment, method 1000 may at 1010 close the first switch to allow energy to transmit to the second switch, and the second switch may be open, such as to inhibit energy transmission to the second communications device, the user interface device, or both. Method 1000 may then at 1020 energize the control system after receiving the user input signal by closing the second switch, such as to allow energy transmission to the second communications device, the user interface device, or both.

Method 1000 may include at 1030 wirelessly coupling a first communications device (e.g., first communications device 320) at the cabinet to the second communications device (e.g., second communications device 220) at the door when the control system is energized. Wirelessly coupling the first communications device to the second communications device permits wireless communication of a control signal from the user interface device to a controller at the cabinet. As described herein, the control signal may include any desired user input, such as, but not limited to, signals corresponding to a desired temperature and/or humidity at one or more refrigeration compartments (e.g., compartments 110, 120).

Method 1000 may include at 1040 opening the circuit between the first switch and the second switch to discontinue or de-energize the control system when the door is closed.

In some embodiments, method 1000 includes at 1050 starting a timer at a user interface device (e.g., a timer device at the user interface device 210) when the door is opened. In still some embodiments, method 1000 at 1050 may include starting the timer when the magnetic device is removed from magnetic communication with the first switch at the door. In still some embodiments, method 1000 includes at 1052 starting a timer at a user interface device when a user input signal is received at the user interface device, such as received via an input component (e.g., input component 134). For instance, the timer may start when a user touches or interacts with the input component 134 or display component 132, such as to generate the user input signal. In various embodiments, method 1000 includes starting a first timer corresponding to the door opening (e.g., step 1050)

and starting a second timer corresponding to receiving the user input signal (e.g., step 1052).

Method 1000 may include at 1060 inhibiting, disabling, or otherwise discontinuing energy draw from the energy source, or energy transfer from the energy source, at or beyond a time threshold. For instance, the time threshold may include, e.g., 15 seconds after starting the timer, or 30 seconds after starting the timer, or 45 seconds after starting the timer, or 60 seconds after starting the timer, or 75 seconds after starting the timer, or 90 seconds after starting the timer, etc. In various embodiments, method 1000 includes discontinuing energy draw from the energy source at or beyond a first time threshold corresponding to the first timer (e.g., step 1050). In still various embodiments, method 1000 includes discontinuing energy draw from the energy source at or beyond a second time threshold corresponding to the second timer (e.g., step 1052). For instance, at or beyond the time threshold, the second switch 250 may be configured to open and discontinue energy transmission to the user interface device 210, such as to disable the display component 132, the input component 134, or both. In another instance, at or beyond the time threshold, the second switch 250 may be configured to open and discontinue energy transmission to the second communications device 220, such as to disable communication between the first and second communications devices 220, 320. It should be appreciated that the first and second time thresholds may differ from one another in duration, such that a first time threshold may be applied to disable the user interface device 210 and a second time threshold may be applied to disable the second communications device 220. In various embodiments, method 1000 includes resetting the timer after opening the first switch, such as after closing the door.

As such, embodiments of the appliance (e.g., appliance 100) including non-rechargeable energy sources may be configured to discharge energy selectively for the expected life of appliance, such as without requiring replacement of the energy source or recharging of the battery.

Embodiments of the appliance 100 and method 1000 depicted and described herein may provide benefits and advantages over appliances and methods for operation that include wiring harnesses passing between a door and cabinet. Embodiments of the appliance 100 and method 1000 provided herein allow the door 104 to be adjusted between right side and left side hinged attachment 105 without requiring routing or re-routing of electrical components (e.g., wiring harnesses) for electronic devices (e.g., user interface devices) at the door. Additionally, or alternatively, embodiments of the appliance 100 and method 1000 provided herein may obviate issues related to wireless power transfer devices, such as transmission limits when the door is opened. Various embodiments of the appliance 100 and method 1000 may further obviate a need for connecting the door to a fixed power supply (e.g., a wall outlet) or charging devices (e.g., wired or wireless charging devices). Still further, or alternatively, embodiments of the appliance 100 and method 1000 provided herein may be more cost effective in contrast to power transmission wiring harnesses through the door.

Further aspects of the invention are provided by the subject matter of the following clauses:

1. A refrigeration appliance, the appliance including a cabinet including a refrigeration compartment, a controller, a first communications device, and a magnetic device, wherein the controller is operably coupled to the first communications device; a door attachable to the cabinet and configured to open and close to selectively allow access to the refrigeration compartment, the door including an energy source, a first switch, a second switch, a second communications device, and a user interface device, wherein the second switch is operably coupled to the second communications device and the user interface device, and wherein the second communications device is in selective operable communication with the first communications device, wherein the first switch is configured to operably couple the energy source to the second switch to allow energy to flow to the second switch, the second communications device, and the user interface device when the door is open, and wherein the first switch is configured to discontinue energy flow to the second switch when the door is closed.

2. The refrigeration appliance of any one or more clauses herein, wherein the first switch is an electromagnetic switch, and wherein the first switch is removed from magnetic communication with the magnetic device when the door is open to allow energy to flow to the second switch.

3. The refrigeration appliance of any one or more clauses herein, wherein the energy source is a battery.

4. The refrigeration appliance of any one or more clauses herein, wherein the energy source is a non-rechargeable battery.

5. The refrigeration appliance of any one or more clauses herein, wherein the energy source includes a lithium primary cell.

6. The refrigeration appliance of any one or more clauses herein, wherein the first communications device includes a wireless receiver communications device.

7. The refrigeration appliance of any one or more clauses herein, wherein the second communications device includes a wireless transmitter communications device, wherein the first communications device and the second communications device are selectively coupled in wireless communication.

8. The refrigeration appliance of any one or more clauses herein, wherein the user interface device includes a timer device configured to discontinue energy draw from the energy source at or beyond a time threshold.

9. The refrigeration appliance of any one or more clauses herein, wherein the refrigeration appliance is a beverage cooler refrigeration appliance.

10. The refrigeration appliance of any one or more clauses herein, wherein the controller is operably coupled to one or more of an evaporator, a condenser, or a flow device.

11. A system for operating a refrigeration appliance, the system including a cabinet including a first communications device, and a magnetic device, wherein the controller is operably coupled to the first communications device; a door attachable to the cabinet and including a controller compartment; a control system positioned at the controller compartment, the control system including an energy source, a first switch, a second switch, a second communications device, and a user interface device, the control system configured to close a circuit from the first switch to the second switch when the first switch is removed from magnetic communication with the magnetic device; and energize the second switch, the second communications device, and the user interface device when the first switch is operably coupled to the second switch.

12. The system of any one or more clauses herein, the control system configured to communicatively couple the first communications device and the second communications device when the second communications device is energized.

13. The system of any one or more clauses herein, the control system configured to begin a timer when the second switch is energized; and discontinue energizing the second switch, the second communications device, and the user interface device when the timer is at or beyond a time threshold.

14. The system of any one or more clauses herein, wherein the control system is configured to close the circuit from the first switch to the second switch when the door is open.

15. The system of any one or more clauses herein, wherein the control system is configured to open the circuit between the first switch and the second switch when the door is closed, wherein opening the circuit discontinues energizing the second switch, the second communications device, and the user interface device.

16. The system of any one or more clauses herein, wherein the energy source, the first switch, and the second switch are in serial arrangement.

17. The system of any one or more clauses herein, wherein the first switch is an electromagnetic switch, and wherein the first switch is positioned in magnetic communication with the magnetic device when the door is closed to discontinue flow of energy to the second switch, and wherein the first switch is removed from magnetic communication with the magnetic device when the door is open to allow energy to flow to the second switch.

18. The system of any one or more clauses herein, wherein the energy source is a non-rechargeable battery.

19. The system of any one or more clauses herein, wherein the first communications device includes a wireless receiver communications device, and wherein the second communications device includes a wireless transmitter communications device, wherein the first communications device and the second communications device are selectively coupled in wireless communication.

20. A method for operating a refrigeration appliance, the method including closing a circuit from an energy source to a second switch through a first switch, wherein the energy source, the first switch, and the second switch are positioned at a door, and wherein the circuit is closed when the first switch is removed from magnetic communication with a magnetic device at the cabinet when the door is opened; energizing a control system at the door, the control system including the second switch, a second communications device, and a user interface device when the first switch is operably coupled to the second switch; wirelessly coupling a first communications device at the cabinet to the second communications device at the door when the control system is energized, wherein wirelessly coupling the first communications device to the second communications device permits wireless communication of a control signal from the user interface device to a controller at the cabinet; and opening the circuit between the first switch and the second switch to de-energize the control system at the door when the door is closed.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigeration appliance, the appliance comprising:

a cabinet comprising a refrigeration compartment, a controller, a first communications device, and a magnetic device, wherein the controller is operably coupled to the first communications device;

a door attachable to the cabinet and configured to open and close to selectively allow access to the refrigeration compartment, the door comprising an energy source, a first switch, a second switch, a second communications device, and a user interface device, wherein the second switch is operably coupled to the second communications device and the user interface device, and wherein the second communications device is in selective operable communication with the first communications device, wherein the first switch is configured to operably couple the energy source to the second switch to allow energy to flow to the second switch, the second communications device, and the user interface device when the door is open, and wherein the first switch is configured to discontinue energy flow to the second switch when the door is closed.

2. The refrigeration appliance of claim 1, wherein the first switch is an electromagnetic switch, and wherein the first switch is removed from magnetic communication with the magnetic device when the door is open to allow energy to flow to the second switch.

3. The refrigeration appliance of claim 1, wherein the energy source is a battery.

4. The refrigeration appliance of claim 3, wherein the energy source is a non-rechargeable battery.

5. The refrigeration appliance of claim 3, wherein the energy source comprises a lithium primary cell.

6. The refrigeration appliance of claim 1, wherein the first communications device comprises a wireless receiver communications device.

7. The refrigeration appliance of claim 6, wherein the second communications device comprises a wireless transmitter communications device, wherein the first communications device and the second communications device are selectively coupled in wireless communication.

8. The refrigeration appliance of claim 1, wherein the user interface device comprises a timer device configured to discontinue energy draw from the energy source at or beyond a time threshold.

9. The refrigeration appliance of claim 1, wherein the refrigeration appliance is a beverage cooler refrigeration appliance.

10. The refrigeration appliance of claim 1, wherein the controller is operably coupled to one or more of an evaporator, a condenser, or a flow device.

11. A system for operating a refrigeration appliance, the system comprising:

a cabinet comprising a first communications device, and a magnetic device, wherein a controller is operably coupled to the first communications device;

a door attachable to the cabinet and comprising a controller compartment;

a control system positioned at the controller compartment, the control system comprising an energy source, a first switch, a second switch, a second communications device, and a user interface device, the control system configured to:

close a circuit from the first switch to the second switch when the first switch is removed from magnetic communication with the magnetic device; and energize the second switch, the second communications device, and the user interface device when the first switch is operably coupled to the second switch.

12. The system of claim 11, the control system configured to:

communicatively couple the first communications device and the second communications device when the second communications device is energized.

13. The system of claim 11, the control system configured to:

begin a timer when the second switch is energized; and discontinue energizing the second switch, the second communications device, and the user interface device when the timer is at or beyond a time threshold.

14. The system of claim 11, wherein the control system is configured to close the circuit from the first switch to the second switch when the door is open.

15. The system of claim 14, wherein the control system is configured to open the circuit between the first switch and the second switch when the door is closed, wherein opening the circuit discontinues energizing the second switch, the second communications device, and the user interface device.

16. The system of claim 11, wherein the energy source, the first switch, and the second switch are in serial arrangement.

17. The system of claim 11, wherein the first switch is an electromagnetic switch, and wherein the first switch is positioned in magnetic communication with the magnetic device when the door is closed to discontinue flow of energy to the second switch, and wherein the first switch is removed from magnetic communication with the magnetic device when the door is open to allow energy to flow to the second switch.

18. The system of claim 11, wherein the energy source is a non-rechargeable battery.

19. The system of claim 11, wherein the first communications device comprises a wireless receiver communications device, and wherein the second communications device comprises a wireless transmitter communications device, wherein the first communications device and the second communications device are selectively coupled in wireless communication.

20. A method for operating a refrigeration appliance, the method comprising:

closing a circuit from an energy source to a second switch through a first switch, wherein the energy source, the first switch, and the second switch are positioned at a door, and wherein the circuit is closed when the first switch is removed from magnetic communication with a magnetic device at a cabinet when the door is opened;

energizing a control system at the door, the control system comprising the second switch, a second communications device, and a user interface device when the first switch is operably coupled to the second switch;

wirelessly coupling a first communications device at the cabinet to the second communications device at the door when the control system is energized, wherein wirelessly coupling the first communications device to the second communications device permits wireless communication of a control signal from the user interface device to a controller at the cabinet; and opening the circuit between the first switch and the second switch to de-energize the control system at the door when the door is closed.

* * * * *